US009810005B2

(12) United States Patent
Rocci et al.

(10) Patent No.: US 9,810,005 B2
(45) Date of Patent: Nov. 7, 2017

(54) VEHICLE DOOR HANDLE COMPRISING AN INERTIAL MASS

(75) Inventors: Antonio Rocci, Creteil (FR); Guillaume Lesueur, Creteil (FR)

(73) Assignee: U-SHIN ITALIA S.P.A, Pianezza (IT)

( * ) Notice: Subject to any disclaimer, the term of this patent is extended or adjusted under 35 U.S.C. 154(b) by 365 days.

(21) Appl. No.: 13/820,618

(22) PCT Filed: Sep. 2, 2011

(86) PCT No.: PCT/EP2011/004425
§ 371 (c)(1),
(2), (4) Date: May 8, 2013

(87) PCT Pub. No.: WO2012/028325
PCT Pub. Date: Mar. 8, 2012

(65) Prior Publication Data

US 2013/0221690 A1 Aug. 29, 2013

(30) Foreign Application Priority Data

Sep. 2, 2010 (IT) ..... MI2010A1598

(51) Int. Cl.
*E05B 3/00* (2006.01)
*E05B 85/10* (2014.01)
*E05B 77/06* (2014.01)
*E05B 85/16* (2014.01)

(52) U.S. Cl.
CPC ..... *E05B 85/10* (2013.01); *E05B 77/06* (2013.01); *E05B 85/16* (2013.01); *Y10T 292/57* (2015.04)

(58) Field of Classification Search
CPC ..... E05B 85/10; E05B 85/14; E05B 85/16; E05B 77/02; E05B 77/04; E05B 77/06; E05B 77/12
USPC ..... 292/336.3, DIG. 22, DIG. 65
See application file for complete search history.

(56) References Cited

U.S. PATENT DOCUMENTS

2009/0243307 A1* 10/2009 Lee ..... 292/93
2011/0298228 A1* 12/2011 Lesueur ..... 292/336.3
2012/0104774 A1* 5/2012 Park et al. ..... 292/336.3

FOREIGN PATENT DOCUMENTS

DE 102005049142 A1 * 4/2007
DE 102008062213 A1 * 6/2010
DE 102008062214 A1 * 7/2010
DE 102009013324 A1 * 9/2010
EP 1 593 802 A1 11/2005
(Continued)

OTHER PUBLICATIONS

International Search Report from PCT/EP2011/004425 dated Mar. 19, 2012 (3 pages).
(Continued)

*Primary Examiner* — Alyson M Merlino
(74) *Attorney, Agent, or Firm* — Osha Liang LLP

(57) ABSTRACT

The vehicle door handle (2) is arranged in such a way that an inertial mass (18) in the handle passes irreversibly from a rest configuration in which it allows the door to be opened into a locking configuration which it prevents opening and passes from the locking configuration into an unlocked configuration, different from the rest configuration and from the locking configuration, the handle being arranged so that placement of the inertial mass (18) in the unlocking configuration has the effect of it once again being possible for the door to be opened.

8 Claims, 4 Drawing Sheets

(56) References Cited

FOREIGN PATENT DOCUMENTS

| | | | | |
|---|---|---|---|---|
| FR | 2 876 135 | A1 | 4/2006 | |
| FR | 2 940 813 | A1 | 7/2010 | |
| FR | WO 2010081618 | A1 * | 7/2010 | ..... E05B 77/06 |
| WO | WO 0100953 | A1 * | 1/2001 | |
| WO | 2006/003197 | A1 | 1/2006 | |

OTHER PUBLICATIONS

Written Opinion of the International Searching Authority issued in PCT/EP2011/004425 dated Mar. 19, 2012 (5 pages).

* cited by examiner

VEHICLE DOOR HANDLE COMPRISING AN INERTIAL MASS

BACKGROUND

The invention concerns vehicle door handles.

Door handles are known equipped with an inertial system adapted, in the event of side impact and by virtue of the effect of the acceleration variation, to assume a locking position that inhibits the mechanism of the handle to prevent any unintentional opening of the door.

There are known in particular reversible type inertial systems and non-reversible type inertial systems.

A reversible system reverts to the rest position after the impact. It has the advantage of allowing opening of the door by means of the handle after the impact. However, it has the drawback of generally being highly sensitive to lateral accelerations in both directions as well as to rebounds. Accordingly, if variations in the direction of the acceleration occur during the impact, it can happen that the system returns to its rest position and renders the mechanism of the handle that was initially inhibited active again. This can lead to movement of the handle because of the effect of the impact and to opening of the door.

A non-reversible inertial system remains in the locking position throughout and after the impact. It has the advantage of not being sensitive to acceleration variations during the impact or to rebounds. It is therefore certain that the handle mechanism is appropriately inhibited throughout the impact, so that the door does not open. However, this system has the disadvantage that the handle mechanism remains inhibited after the impact and thus makes intentional opening of the door by maneuvering the handle impossible.

An object of the invention is to provide a handle that combines the advantages of both types of system without their disadvantages.

SUMMARY OF INVENTION

To this end the invention provides a vehicle door handle such that an inertial mass in the handle passes irreversibly from a rest configuration in which it allows the door to be opened to a locking configuration in which it prevents opening and goes from the locking configuration into an unlocking configuration and then to the rest configuration.

Accordingly, thanks to the non-reversible change from the rest configuration to the locking configuration, the handle mechanism remains inhibited throughout the impact. This therefore prevents any unintentional opening of the door during the impact. However, after going from the locking configuration to the unlocking configuration and then to the rest configuration, the handle mechanism is rendered active again, so that the door can be opened to enable an occupant to exit the vehicle. This handle thus combines the advantages of the systems of the two types cited above at the same time as alleviating their disadvantages.

The handle preferably includes clipping means adapted to immobilize the mass in the locking configuration when it reaches it from the rest configuration.

The handle is advantageously such that the movement from the locking configuration to the unlocking configuration leads to disengagement of the clipping means.

The handle is preferably such that the movement from the locking configuration to the unlocking configuration can be commanded by means of an external member of the handle.

Accordingly, subject to intentional action on the external member, the handle mechanism is disinhibited. This action can be effected by an occupant of the vehicle or by an external person as appropriate and according to the embodiment chosen for the handle. It notably takes place when opening can be effected safely.

The external member is advantageously a member for opening the door.

Accordingly, it is the actuating member of the handle itself that enables disinhibition of the mechanism to open the door.

The handle is preferably such that the movement from the locking configuration to the unlocking configuration can be commanded only by application of a force exceeding a predetermined threshold.

Accordingly, the risks of unintentional unlocking of the mechanism of the handle are reduced. The person who wishes to open the door must apply a particular force in this sense.

In one embodiment the handle includes an abutment adapted to be deformed during the movement from the locking configuration to the unlocking configuration.

This is a particularly simple way to implement the aforementioned feature relating to the intensity threshold.

The handle advantageously includes a member for returning the mass to the rest configuration.

One element of a pair of elements comprising a support and the mass preferably includes a ramp and the other element of the pair of elements comprising the support and the mass preferably includes a follower adapted to come to bear on the ramp so that the ramp and the follower guide the movement from the rest configuration to the locking configuration and then to the unlocking configuration.

In one embodiment the mass is rotatably mounted on a support of the handle.

BRIEF DESCRIPTION OF DRAWINGS

Other features and advantages of the invention will become more apparent in the course of the following description of an embodiment given by way of nonlimiting example with reference to the appended drawings, in which.

DETAILED DESCRIPTION

An automobile vehicle door handle of one embodiment of the invention will be described hereinafter. The door can be a front door, a rear door or a tailgate. Here reference is made to an external handle enabling maneuvering of the door to unlock it and open it from outside the vehicle. The invention is nevertheless equally applicable to an internal handle for opening the door.

There is used hereinafter the orthogonal system of axes XYZ in which the horizontal directions X and Y are respectively parallel and perpendicular to the direction of movement of the vehicle and the direction Z is vertical.

Figure 1:
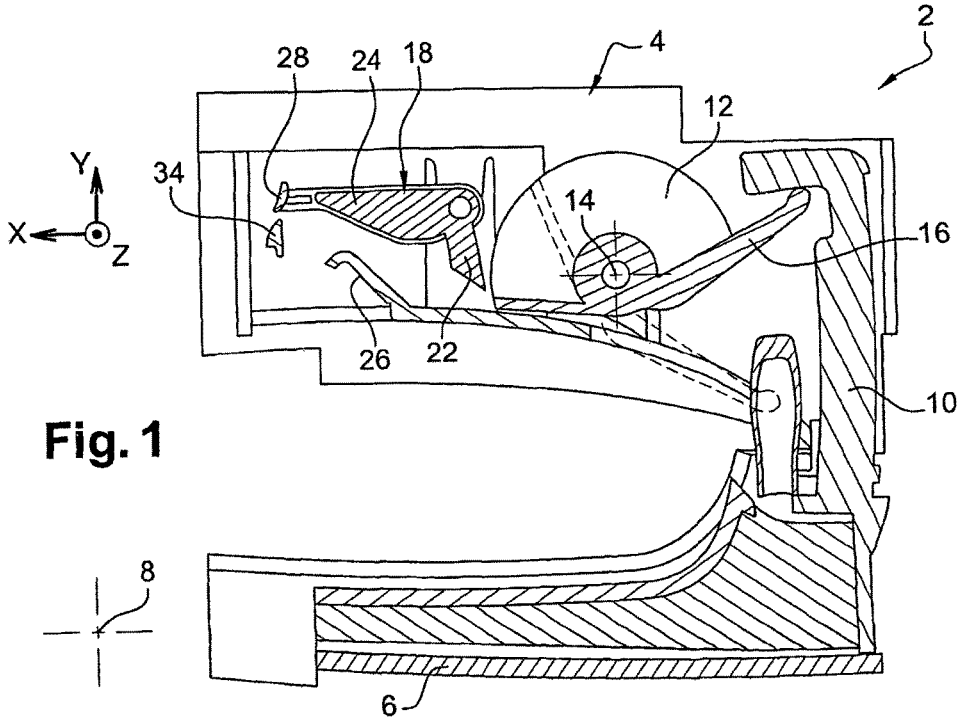
FIGS. 1 to 3 are three views in horizontal section of a handle of one embodiment of the invention, showing three respective steps in the operation of the handle.
Figure 2:
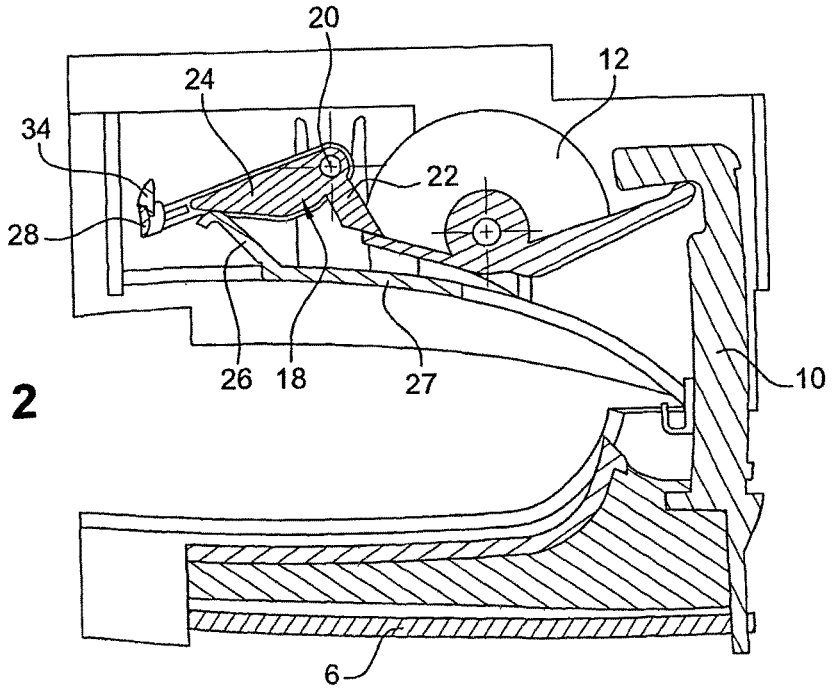
Figure 3:
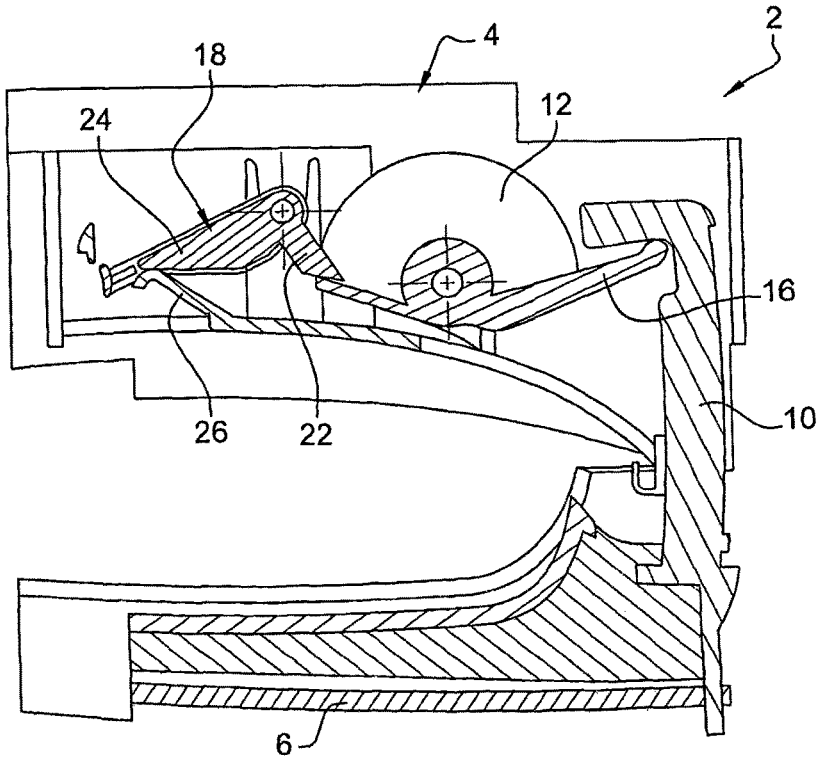
Figure 4:
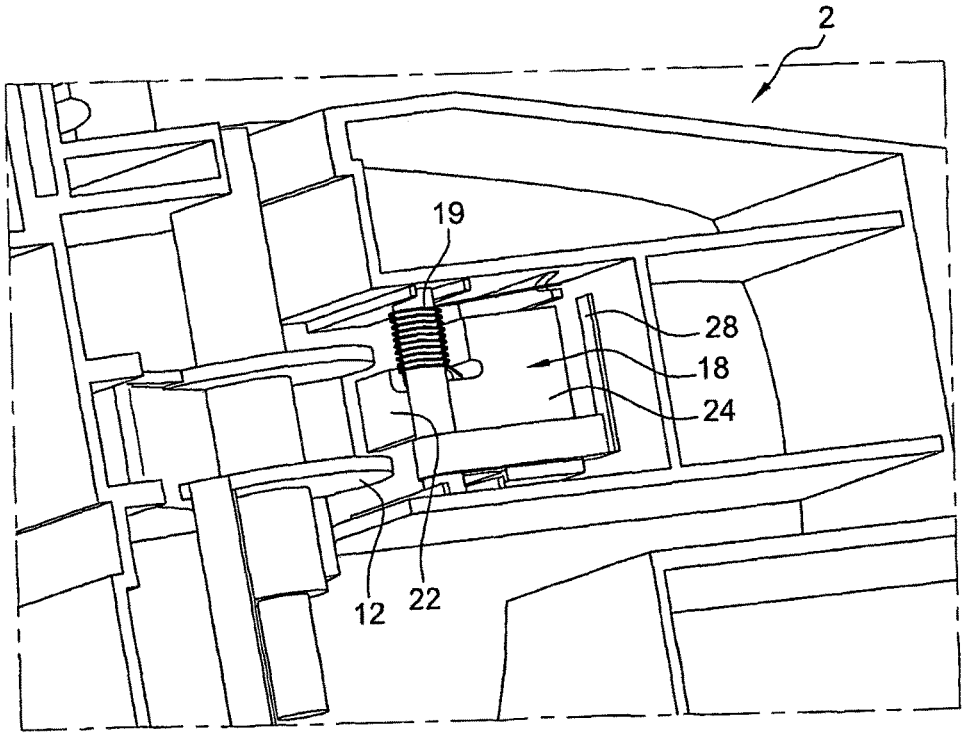
FIGS. 4 to 9 are partial views in perspective of the same handle showing different steps in the operation of the handle.

Referring first to FIGS. 1 to 3, the handle 2 includes a support or frame 4 rigidly fastened to the structure of the door.

It includes an external holding part 6 intended to be actuated manually by a user wishing to open the door from outside the vehicle. Here this part 6 is articulated to the support 4 about a vertical shaft 8 by means known in themselves that are not described in detail here. The holding part 6 is extended inside the handle and the door by an extension 10 extending in the direction Y.

The handle 2 includes a lever 12 mounted to be mobile in rotation relative to the support 4 about a vertical shaft 14. This lever notably includes an arm 16 on the trajectory of an edge of the extension 10 so that, when a user maneuvers the holding part 6 outwards in the direction Y, the extension 10 entrains the arm 16, which causes the lever 12 to turn. Two positions of the lever 12 about its axis are shown in FIG. 1.

The lever is connected in a manner that is not shown and that will not be described here to other parts of the handle mechanism, notably a traction cable. This mechanism serves to unlock the door relative to the body of the vehicle.

The handle 2 also includes an inertial system including a part 18 forming a mass mounted to be mobile in rotation relative to the support 4 about a vertical shaft 20. This part comprises two profiled portions 22 and 24 such that the part as seen in section in FIGS. 1 to 3 is generally V-shaped.

The mass 18 can occupy different positions about its shaft 20.

In the rest position shown in FIG. 1, the locking part 22 is not on the trajectory of the lever 12 and therefore allows it to rotate and enables the door to be opened by the action of the holding part 6.

In the locking position shown in FIG. 2, the compression part 24 of the mass 18 bears against an abutment 26 rigidly fastened to the support 4. The locking part 22 is on the trajectory of the lever 12, which it therefore prevents from turning, with the result that it inhibits the handle mechanism. Because of this it holds the holding part 6 in position and prevents opening of the door.

The compression part 24 has a mass greater than that of the locking part 22.

A spring 19 for returning the mass to its rest position bears on the one hand on the mass and on the other hand on the support 4.

An idea of the operation of the handle may already be obtained from FIGS. 1 to 3, although it will nevertheless be described in detail hereinafter.

FIG. 1 shows the handle in the rest configuration of all the parts. The locking part 22 is not on the trajectory of the lever and its compression part 24 is at a distance from the abutment 26. If a user wishes to open the door, they actuate the holding part which with the extension 10 entrains the lever 12 in rotation about its shaft to unlock the door. The return spring 19 holds the mass 18 out of the trajectory of the lever 12 in order for the extension 10 to be able to entrain the latter freely.

Referring to FIG. 2, it is assumed that a lateral impact to the vehicle occurs in the direction Y and that this impact is such that, through inertia, the holding part 6 begins a movement toward the exterior of the vehicle. The inertial mass 18 has moved beforehand by turning anticlockwise relative to its FIG. 1 position until the part 24 comes to bear against the abutment 26. In this locking configuration the part 22 is on the trajectory of the lever 12, any further rotation of which it prevents, despite the load exerted by the extension 10. The holding part is therefore retained in position against the force generated by the acceleration of the impact. This therefore prevents any unintended opening of the door. As will emerge hereinafter, the movement of the mass 18 from the FIG. 1 rest configuration to the FIG. 2 locking configuration is effected in an irreversible manner, with the result that this mass remains in the locking configuration throughout and after the impact.

In FIG. 3 it is assumed that the impact phase has ended and that a user wishes to open the door from the outside. The user actuates the holding part 6, applying a force having an intensity exceeding a predetermined threshold and such that the load transmitted by the lever 12 to the mass 18 forces the latter to deform the abutment 26. This movement causes the mass 18 to move from the FIG. 2 locking configuration to the unlocking configuration shown in FIG. 3.

The user releases the holding part, which causes the mass 18 to return to the rest configuration because of the effect of the spring.

By maneuvering the holding part 6 again, the user can thus open the door normally.

Some aspects of the handle 2 will now be described in more detail.

The compression part 24 of the mass 18 carries at its free end a tongue 28 parallel to the shaft 20. The tongue is rigidly fastened to the part 24 by and only by its lower end area so that it is elastically flexible relative to the rest of the mass 18. It is at the level of its free upper end that it has the greatest amplitude of movement relative to the rest of this part.

The support 4 has on an upper wall 32 a raised pattern 34 forming a ramp for the tongue 28 that functions as a follower. The raised pattern 34 has a convex curved front face 36, an internal face 38, a front face 40, an internal face 42 and a rear face 44. The faces 38, 40, 42 and 44 are plane and vertical. The faces 38 and 42 are perpendicular to the direction Y while the faces 40 and 44 are perpendicular to the direction X.

The raised pattern and the tongue form clipping means adapted to cooperate as follows.

Figure 10:
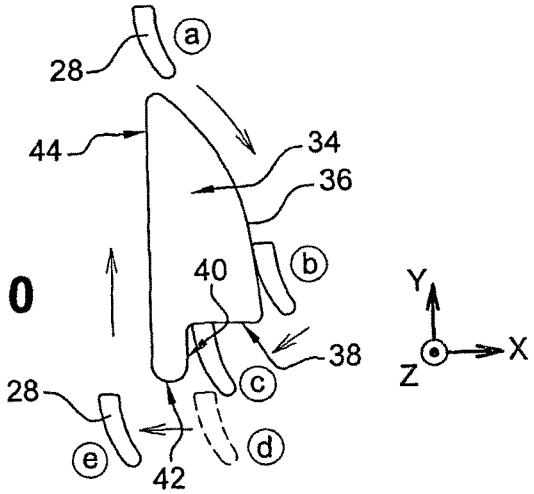
FIG. 10 is a view in elevation showing the trajectory of the follower relative to the ramp in the handle from the preceding figures.

Various positions of the free end of the tongue 28 relative to the raised pattern 34 are shown in FIG. 10.

Figure 5:
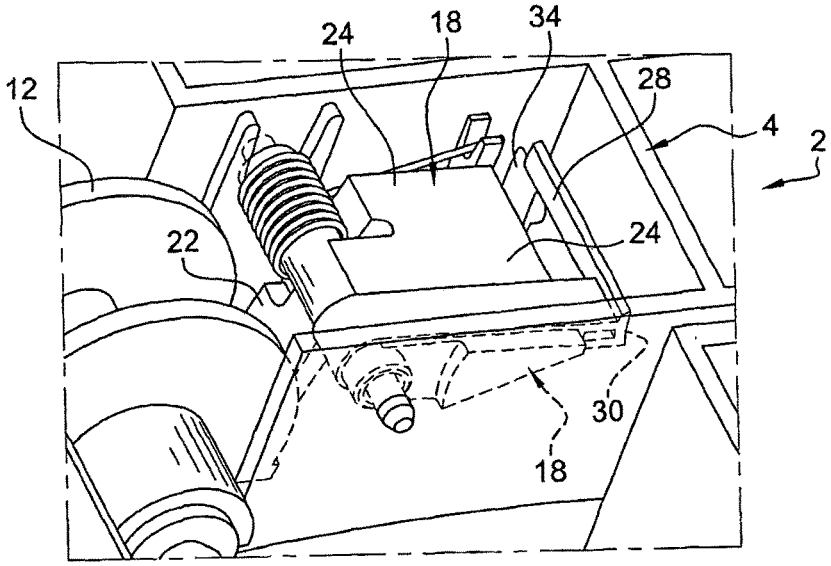
Figure 6:
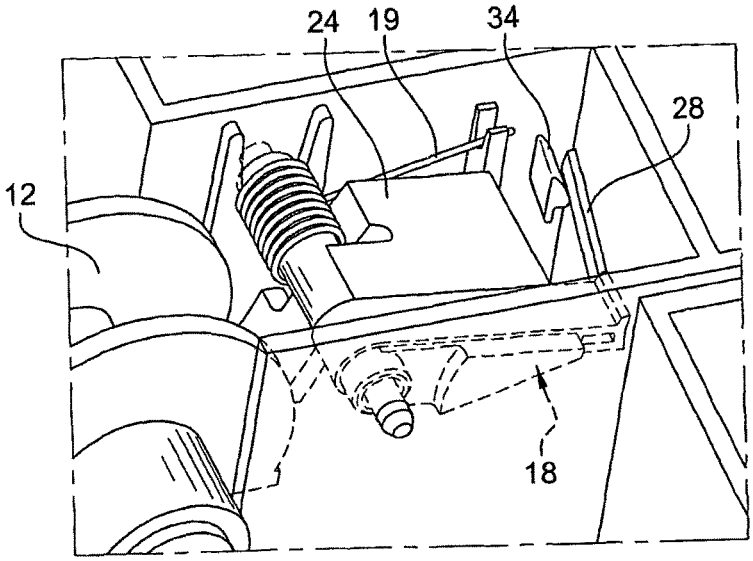
Figure 7:
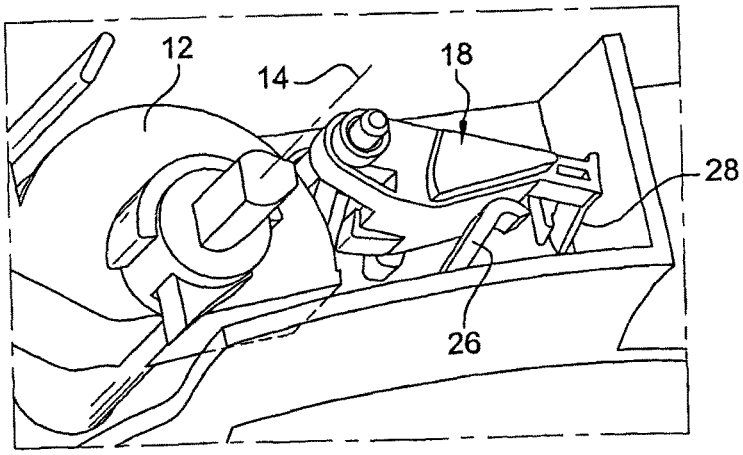
Figure 8:
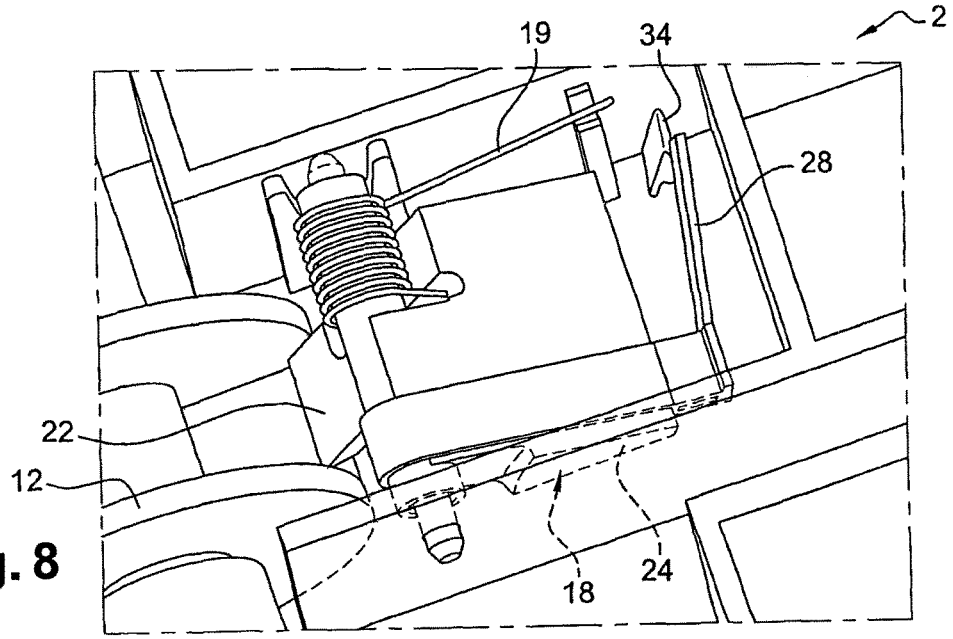
Figure 9:
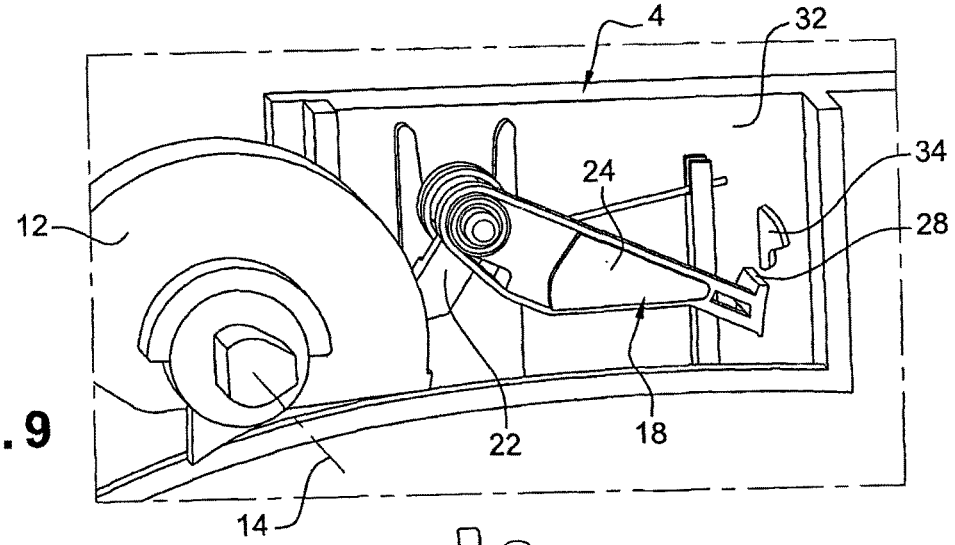

In the rest position a shown in FIGS. 1 and 5, the end of the tongue 28 faces the raised pattern and the rear part of the curved face 36.

When the mass 18 moves from the rest configuration to the locking configuration, the tongue 28 comes into contact with the rear part of the face 36, after which, by virtue of a ramp effect, it follows the latter as far as the position b at its inner end. This contact is maintained along the face 36 because of the elastic loading applied to the raised pattern by the tongue, given the deformation of the tongue. After the tongue has passed beyond the inner end of the face 36, it is returned elastically and rearwardly against the face 40 and remains abutted against both the latter and the face 38 in the position c. The locking configuration has been reached at this stage. Given this abutment, the mass 18 is not able to pass directly from the locking configuration to the rest configuration by the reverse movement, thus rendering the movement that has just been described non-reversible.

When, starting from the locking configuration, a user actuates the holding part 6 to force rotation of the mass against the abutment 26, the tongue 28 moves in the direction Y from the position c to the position d in which it is no longer abutted against the facet 40 in the direction X. It faces the face 38 but no longer faces the face 40. The elastic return force resulting from the deformation of the tongue then moves the latter in the direction X to the position e, beyond the face 44, after passing beyond the face 42. An additional rigid abutment may be provided for certain prevention of movement of the mass beyond the unlocking position when it is moved in this way from the locking position.

When the user releases the holding part 6, the rotation of the lever 12 in the anticlockwise direction allows rotation of the mass 18 in the clockwise direction by the spring 19. This rotation is allowed because the raised pattern 34 is no longer on the trajectory of the tongue. The latter therefore moves in the direction Y in front of the face 44 to return to the position a.

During this operation, the trajectory of the end of the tongue forms a loop and does not pass through the same position twice. It follows in particular from this that the mass 18 must move from the locking configuration via the unlocking configuration to be able to return to the rest configuration.

The abutment 26 is elastic. Its dimensions and its shape condition the intensity of the force that the user must apply to cause the mass 18 to move from the locking configuration to the unlocking configuration.

Note that the tongue 28 and the raised pattern 34 form clipping means. The engaged or clipped position corresponds to the locking configuration. The movement from the latter configuration to the unlocking configuration leads to disengagement of the clipping means.

The handle of the invention therefore has the advantage both of providing a non-reversible inertial system which therefore remains in the locking configuration throughout and after the impact and of allowing intentional opening of the door under the control of a user after the impact.

Of course, numerous modifications may be made to the invention without departing from the scope of the invention.

The move from the locking configuration to the unlocking configuration could be driven by a member other than the external holding part or an internal holding part of the handle, for example by means of a member dedicated to this function.

The deformable abutment could be carried by the inertial mass and not by the support.

In one embodiment, the rotation shaft of the inertial mass may be chosen to be sufficiently deformable for a rigid abutment 26 to be used, the deformability allowing the movement to the unlocking configuration being provided by the deformability of the shaft for elastic swinging of the mass 18 around the abutment 26.

The tongue 28 could be carried by the support and the raised pattern could be carried by the inertial mass.

In one embodiment of the invention the unlocking configuration is in itself a configuration in which opening of the door by actuating the exterior holding member is allowed.

This is notably the case when the inertial mass 18 is forcibly movable out of the trajectory of the lever 12 to allow that lever to reach its position for opening the door. The return to the rest position may thereafter be allowed or not. Returning to the rest position is for example allowed by the means described with reference to FIG. 10.

The retraction of the inertial mass 18 can equally be produced by providing for the inertial mass to come to bear because of the effect of the impact against one or more elastic abutments but not to come to bear against any rigid abutment, in contrast to the embodiment described above in which such an additional rigid abutment can be provided for certain stopping of the mass in the unlocking position.

The deformable plastic material abutment 26 then has a rigidity adapted to prevent retraction of the inertial mass because of the effect of the inertia of the impact as transmitted to the inertial mass by the lever 12, but is sufficiently flexible to allow retraction of the inertial mass by crushing of the abutment 26 because of the effect of manual traction applied to the exterior holding member of the handle.

In another embodiment the deformable abutment 18 may be replaced by a leaf spring or a coil spring the rigidity and the travel of which are adjusted to the same end.

The deformable abutment 26 may equally be produced in the form of an elastomer shoe fixed to the handle support and the deformability of which allows the inertial mass no longer to inhibit opening when the handle is forced open, but is sufficiently firm to stop the inertial mass in the locking configuration because of the effect of the inertial force transmitted thereto, notably via the transmission lever. The positioning of such an elastomer abutment is for example the same as that of the elastic abutment 26 described above.

In a further embodiment, a rigid or elastic abutment is provided for the mass 18 together with a rotation shaft of the inertial mass 18 having a deformability that is such as to allow swinging of the inertial mass out of the trajectory of the lever 12, but movement of the inertial mass transversely to that shaft. The shaft is then advantageously made of metal with spring return means for reverting to the initial operating situation of the handle after an impact followed by forced opening of the handle. The rotation shaft is for example chosen to be sufficiently deformable for a rigid type abutment 26 to be adopted for the inertial mass, the deformability allowing the movement to the unlocking configuration being provided by the deformability of the shaft itself. Again, the shaft advantageously has sufficient rigidity to retain the inertial mass in the locking configuration because of the effect of the inertial forces alone.

The invention claimed is:

1. An outside vehicle door handle mountable on a door of a vehicle, comprising:

a holding part capable of being grasped and pulled by a user outside of the vehicle;

an inertial mass that passes irreversibly from a rest configuration, in which the inertial mass allows the door to be opened, to a locking configuration, in which the inertial mass prevents the door from being opened due to an acceleration variation, wherein the inertial mass is immobilized in the locking configuration throughout and after the occurrence of the acceleration variation, and then the inertial mass passes, upon pulling of the holding part by a user from outside the vehicle, from the locking configuration into an unlocking configuration, different from the rest configuration and from the locking configuration, wherein the placing of the inertial mass in the unlocking configuration enables the inertial mass to return to the rest configuration, thereby allowing the door to be opened.

2. The handle as claimed in claim 1, wherein pulling of the holding part by a user when the inertial mass is in the rest configuration causes movement of a transmission lever, the inertial mass being disposed on a trajectory of the movement of the transmission lever when the inertial mass is in the locking configuration, and the inertial mass being moved to be retracted out of the trajectory of the movement of the transmission lever when the inertial mass is in the unlocking configuration.

3. The handle as claimed in claim 1, further comprising clipping means for immobilizing the inertial mass in the locking configuration upon reaching the locking configuration from the rest configuration.

4. The handle as claimed in claim 3, wherein the passing of the inertial mass from the locking configuration to the unlocking configuration leads to disengagement of the clipping means.

5. The handle as claimed in claim 4, further comprising an abutment adapted to be deformed during the passing of the inertial mass from the locking configuration to the unlocking configuration.

6. The handle as claimed in claim 1, further comprising a pattern member for guiding the passing of the inertial mass through the locking configuration and unlocking configuration, and guiding the returning of the inertial mass to the rest configuration.

7. The handle as claimed in claim 1, wherein one element of a pair of elements, comprising a support and the inertial mass, includes a ramp, and the other element of the pair of elements, comprising the support and the inertial mass, includes a follower adapted to come to bear on the ramp so that the ramp and the follower guide the passing of the inertial mass from the rest configuration to the locking configuration and then to the unlocking configuration.

8. The handle as claimed in claim 1, wherein the inertial mass is rotatably mounted on a support of the handle.

* * * * *